US006002367A

United States Patent [19]

Engblom et al.

[11] Patent Number: 6,002,367

[45] Date of Patent: Dec. 14, 1999

[54] PLANAR ANTENNA DEVICE

[75] Inventors: Gunnar Engblom, Åkerberga; Bo Wass; Gunnar Filipsson, both of Linköping, all of Sweden

[73] Assignee: Allgon AB, Akersberga, Sweden

[21] Appl. No.: 08/858,621

[22] Filed: May 19, 1997

[30] Foreign Application Priority Data

May 17, 1996 [SE] Sweden ..... 9601893

[51] Int. Cl.[6] ..... H01Q 1/38

[52] U.S. Cl. ..... 343/700 MS; 343/702; 343/846; 343/872

[58] Field of Search ..... 343/700 MS, 872, 343/846, 702; H01Q 1/38

[56] References Cited

U.S. PATENT DOCUMENTS

| | | | |
|---|---|---|---|
| 4,749,996 | 6/1988 | Tresselt | 343/700 |
| 5,043,738 | 8/1991 | Shapiro et al. | 343/700 |
| 5,355,143 | 10/1994 | Zurcher et al. . | |
| 5,365,246 | 11/1994 | Rasinger et al. . | |
| 5,489,913 | 2/1996 | Raguenet et al. | 343/767 |
| 5,532,643 | 7/1996 | Kuffner et al. . | |
| 5,757,326 | 5/1998 | Koyama et al. | 343/767 |
| 5,801,660 | 9/1998 | Ohtsuka et al. | 343/700 MS |

FOREIGN PATENT DOCUMENTS

| | | |
|---|---|---|
| 0177362 | 4/1986 | European Pat. Off. . |
| WO95/24745 | 9/1995 | WIPO . |
| WO95/24746 | 9/1995 | WIPO . |

OTHER PUBLICATIONS

Milligan, T.A., "Modern Antenna Design", McGraw–Hill 1985, pp. 117–119.

Handbook of Microstrip Antennas, Edited by J.R. James & P.S. Hall, Peter Peregrinus Ltd., 1989, vol. 2, pp. 1093–1096.

Pozar, D.M., "Microstrip Antenna Aperture—Coupled to a Micro–stripline", Elec. Letters, vol. 21, No. 2, Jan. 1985, pp. 45–50.

G. Le Ray et al, "Frequency agile slot–fed patch antenna", Electronics Letters, vol. 32, No. 1, 1996, pp. 2–3.

M. Himdi et al, "Transmission line analysis of aperture–coupled microstrip . . . ", Elec. Letters, vol. 25, No. 18, 1989, 1229–1230.

M. Sanad, "Effect of the shorting posts on short circuit micro–strip . . . ", Pric. IEEE Antenna Prop. Symp., 1994, pp. 794–797.

K. Tsunoda et al, "Analysis of planar inverted F antenna using spatial network method", IEEE, 1990, pp. 664–667.

Handbook of Microstrip Antennas, Edited by J.R. James & P.S. Hall, Peter Peregrinus Ltd., 1989, vol. 1, pp. 330–337.

M.A. Jensen et al, "FDTD analysis of PIFA diversity antennas on a hand–held transceiver unit", IEEE, 1993, pp. 814–817.

(List continued on next page.)

*Primary Examiner*—Hoanganh Le
*Assistant Examiner*—Hoang Nguyen
*Attorney, Agent, or Firm*—Jacobson, Price, Holman & Stern, PLLC

[57] ABSTRACT

An compact antenna device which is intended for a small-size portable radio communication device and comprises a ground plane (1), a first radiating patch (2), a grounding means (3) connecting the patch and the ground plane. The patch is fed by a feeding means (6) which is situated on the same or opposite side of the ground plane or coplanar therewith and couples through a slot (5) provided in the ground plane. The disclosed antenna device may include further radiating patches in the same or higher levels as the first radiating patch. The antenna device also provides for wideband and/or multiband operation.

55 Claims, 12 Drawing Sheets

OTHER PUBLICATIONS

P.L. Sullivan et al, "Analysis of an Aperture Coupled Microstip Antenna", IEEE Trans . . . , vol. AP–34, No. 8, Aug. 1986, pp. 977–984.

Z.D. Liu et al, "Dual–band antenna for hand held portable telephones", Electronics Letters, vol. 32, No. 7, Mar. 1996, p. 609.

M. Yamazaki et al, "Construction of a slot–coupled planar . . . ", Electronics Letters, vol. 30, No. 22, 1994, pp. 1814–1815.

L. Giauffret et al, "Experimental and theoretical investigations of . . . ", Elec. Letters, vol. 31, No. 25, 1995, pp. 2139–2140.

R. A. Lainati, "CAD of Microstrip Antennas for Wireless Applications", Artech House, 1996, pp. 66–69.

PLANAR ANTENNA DEVICE

FIELD AND BACKGROUND OF THE INVENTION

The invention relates to the field of planar antenna devices, and especially to a planar antenna device including a conductive first plate acting as a ground plane, a second conductive plate and a grounding means connecting the second conducting plate and the ground plane. Specifically, it relates to an aperture-coupled planar antenna device for a mobile radio communication device, e.g., a hand-portable telephone. The invention further relates to this type of antenna which is intended for operation within two separated frequency bands.

PRIOR ART

U.S. Pat. No. 5,355,143 discloses an antenna device wherein a half wave patch radiating element is mounted on a dielectric carrier spaced on a first side from and parallel to a ground plane which is provided with a slot. On a second side of the ground plane there is provided a feeding probe which feeds the patch by coupling energy through the slot. The ground plane, the feeding probe, and a conductive plate together form a stripline. The teachings of that document are directed towards an antenna array and the antenna devices thereof are excessively large when integration in portable radio communication equipment is considered.

U.S. Pat. No. 5,365,246 discloses another antenna device consisting of two parallel elongated L-shaped radiating elements which are parallel to and mounted in one end to a ground portion and which are fed by one or two probes. Those radiating elements have a slot between them which has a smaller width at free ends of the elements. That antenna device is more suited for portable equipment, but it has the disadvantage of a complicated design with regard to the feeding probes. However, that document is regarded to disclose the prior art closest to the invention.

The above-mentioned documents are incorporated herein by reference.

SUMMARY OF THE INVENTION

A main object of the invention is to provide a compact antenna device with high antenna performance which is suited for production in large quantities.

A particular object of the invention is to provide an antenna device which may be integrated in a portable radio device, e.g., small-size mobile telephone.

Another object is to provide an antenna device with improved bandwidth and matching features.

Other objects of the invention are to provide a dual or multi band antenna device, to provide an antenna device which is capable of directing the radiation away from the body of an operator so as to avoid radiation absorption in the body, and to provide very short radiating structures in relation to the wavelength.

These and other objects are attained by an antenna device according to the appended claims.

DESCRIPTION OF A PREFERRED EMBODIMENT

Figure 1:
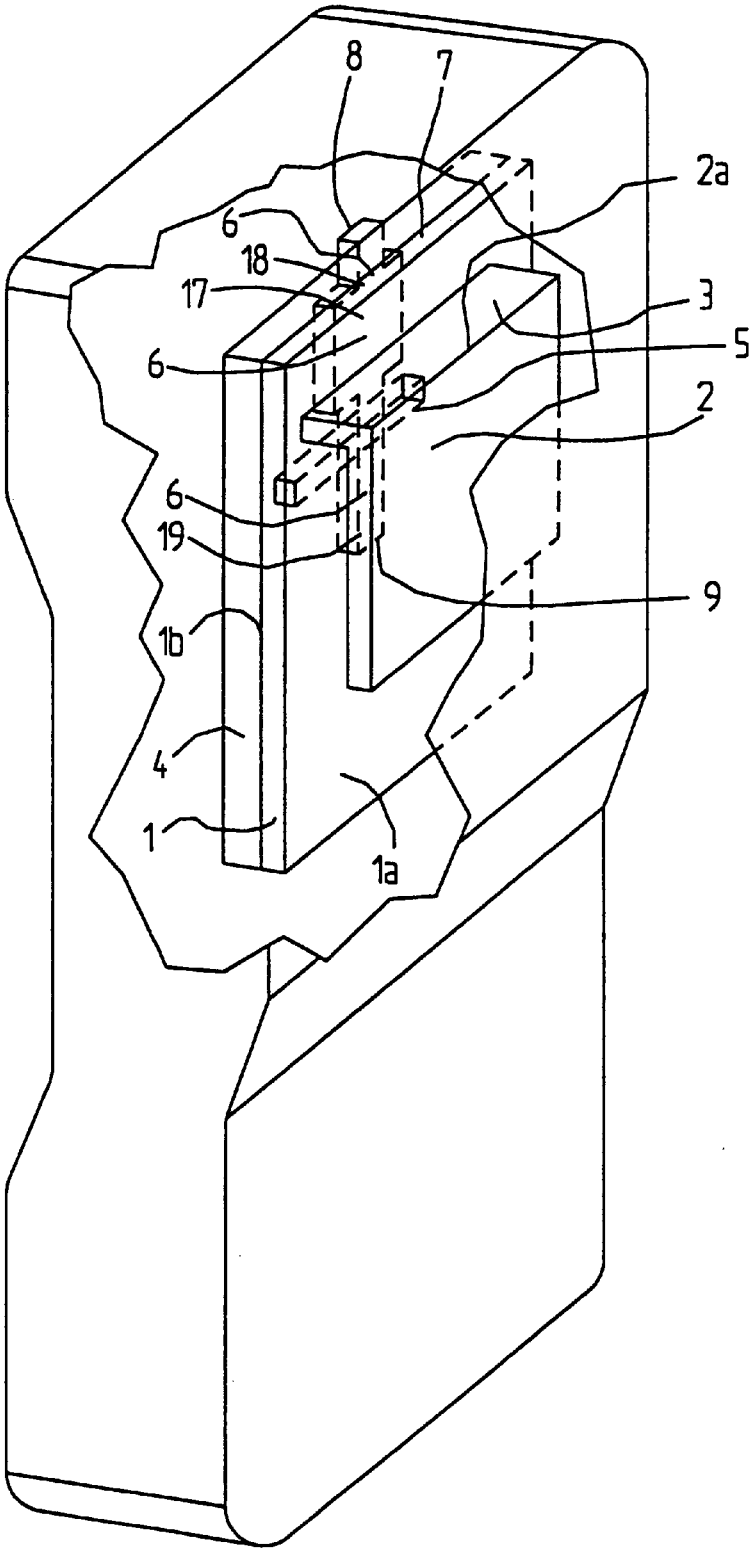
FIG. 1 shows a perspective view of a mobile telephone provided with a first general embodiment of an antenna device according to the invention including a ground plane having a slot aperture, a radiating plate grounded along one edge, and a feed conductor.
Figure 2A:
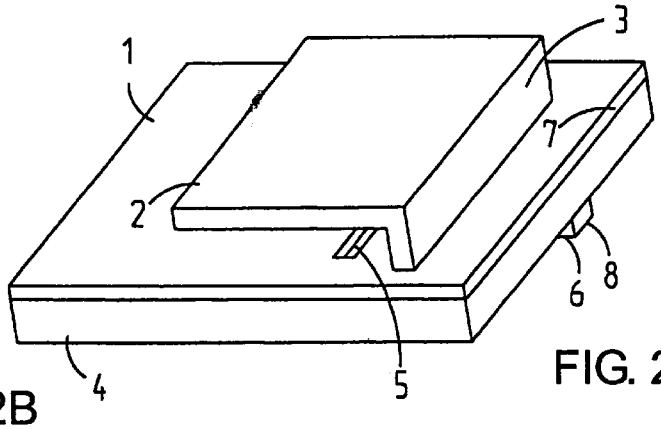
FIGS. 2A–E show views of the first general embodiment according to the invention including conductive plates, grounding means, a slot, a dielectric, and a feed conductor.
Figure 2B:
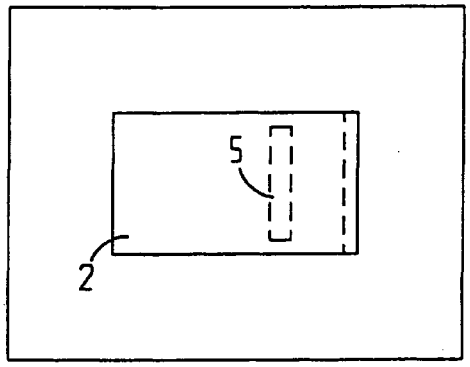
Figure 2E:
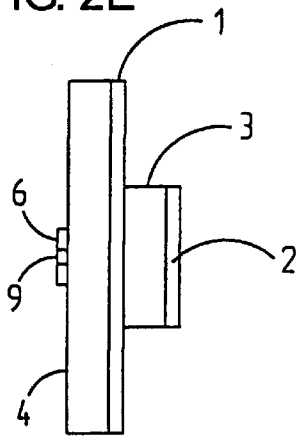
Figure 2C:
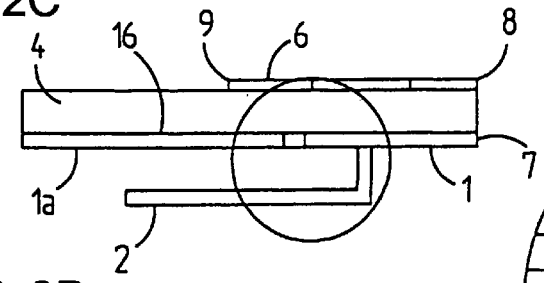
Figure 2F:
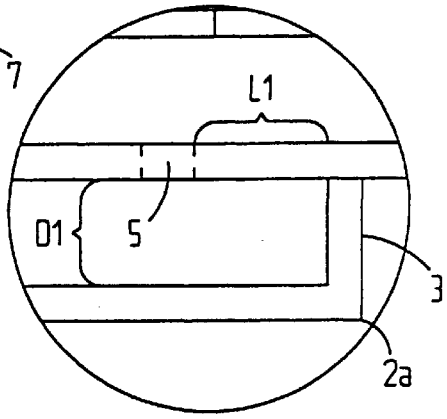
Figure 2D:
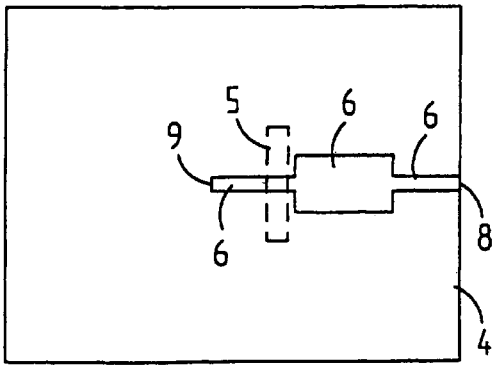

With reference to FIG. 1, a small-size mobile telephone is provided at its back side, preferable at a portion in which an operator is not typically gripping the telephone, with an antenna device according to the invention. The antenna device, which is preferably mounted inside and parallel to a non-conductive chassis wall of the telephone, includes a conductive ground plane or conductive first plate 1 having an outer side 1*a* and an inner side 1*b*, a radiating patch or conductive second plate 2 parallel to the ground plane 1, a grounding means 3 connecting the patch 2 to the outer side 1*a* of the ground plane 1 along one edge of the radiating patch 2. A slot aperture 5 is provided in the ground plane under the patch 2 in the proximity of and alongside the grounding means 3. On the inner side 1*b*, there is provided a dielectric plate 4 which carries the ground plane on the one side and a feeding conductor 6 on the other.

The feeding conductor 6 extends across the slot 5, perpendicular to the slot 5 and to the grounded edge 2*a* of the patch 2. The feeding conductor 6 consists in order of a feed portion 8 which is connected to telephone circuitry (not shown), a first line portion 18, a quarter-wave transformer 17 for matching the impedance of the antenna to a standardized impedance of the circuitry (50 ohms), and a second line portion 19 extending across the slot 5 by essentially one quarter of a wavelength and ending by an open end 9. Alternatively the feeding conductor 6 is connected to the ground plane 1 at its end 10 directly after extending across the slot 5. In this way, an effective feed of the patch 2 is attained. However, there are many alternative configurations of the aperture and the feed line. The ground plane 1 is also connected at a feeding portion 7 thereof to the telephone circuitry.

Figure 3:
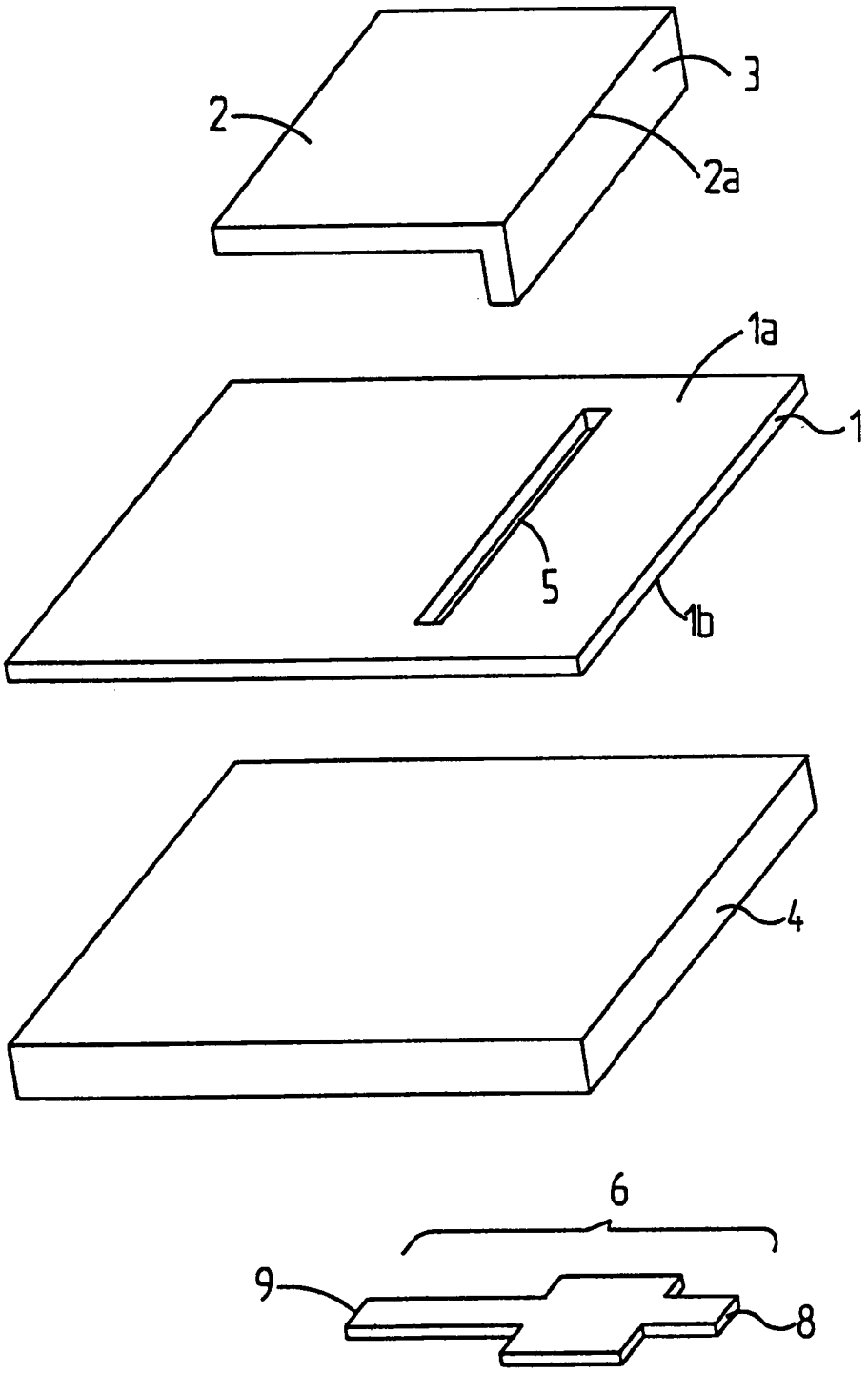
FIG. 3 shows in an exploded view parts of the antenna device of FIGS. 2A–E.
Figure 4A:
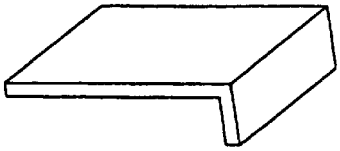
FIGS. 4A–K show different embodiments and variations of the radiating patch of FIG. 3.
Figure 4B:
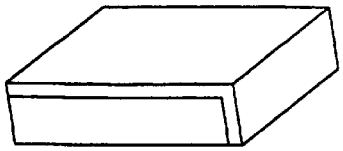
Figure 4C:
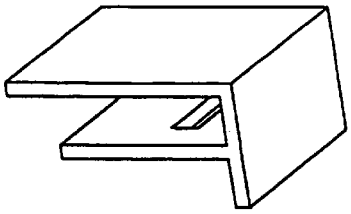
Figure 4D:
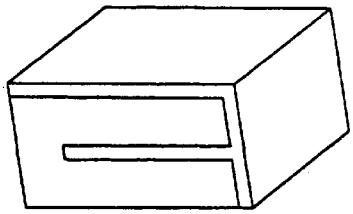
Figure 4E:
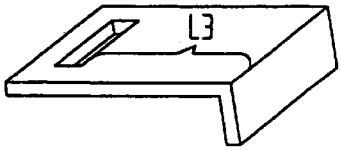
Figure 4F:
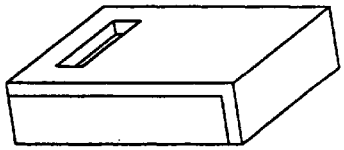
Figure 4G:
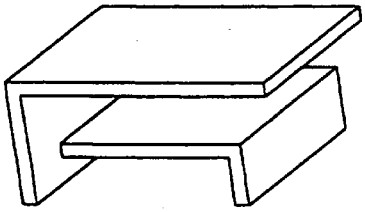
Figure 4H:
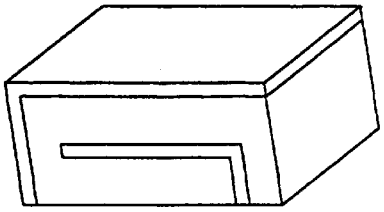
Figure 4I:
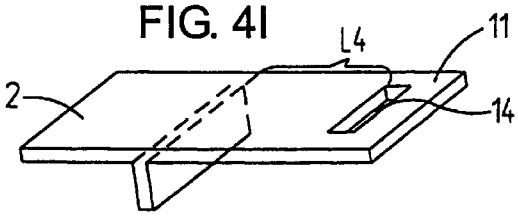
Figure 4J:
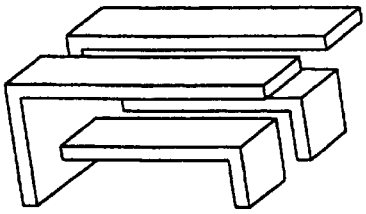
Figure 4K:
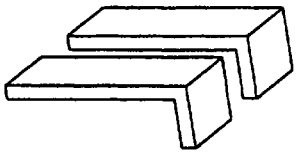

For clarity, FIGS. 2 and 3 show details, having corresponding reference numerals, and views of the antenna device described with reference to FIG. 1.

In FIGS. 8A–D antenna devices, according to the invention are shown in perspective views. Each of these antenna devices includes a conductive ground plane or conductive first plate 1 having an outer side 1*a* and an inner side 1*b*, a radiating patch or conductive second plate 2 at a distance from the ground plane 1, and a grounding means 3 connecting the patch 2 to the outer side 1*a* of the ground plane 1 along one edge 2*a* of the radiating patch 2. A slot aperture 5 is provided in the ground plane under the patch 2 in the proximity of and alongside the grounding means 3. On the outer side 1*a* there is also provided a dielectric plate 4 which carries a feeding conductor 6. The dielectric plate covers the ground plane 1 or parts thereof in order to provide insulation between the ground plane 1 and the feeding conductor 6.

The feeding conductor 6 extends across the slot 5, preferably perpendicular to the slot 5 and to the grounded edge 2*a* of the patch 2. The feeding conductor 6 includes in order, a feed portion 8 which is connected to telephone circuitry (not shown), a first line portion 18, preferably a device 17 (quarter-wave transformer) for matching the impedance of the antenna to a standardized impedance of the circuitry, a second line portion 19 extending across the slot 5, and an open end 9, preferably at a distance from the aperture of approximately one quarter of a wavelength, of the signal which is to be transmitted or is received by the antenna device. Alternatively the feeding conductor 6 is connected to the grounding means 3 or the ground plane at its end 10 directly after extending over the slot 5. In this way, an effective feed of the patch 2 is attained. However, there are many alternative configurations of the aperture and the feed line. The ground plane 1 is also connected at a feeding or grounding portion 7 thereof to the telephone circuitry.

Figure 8A:
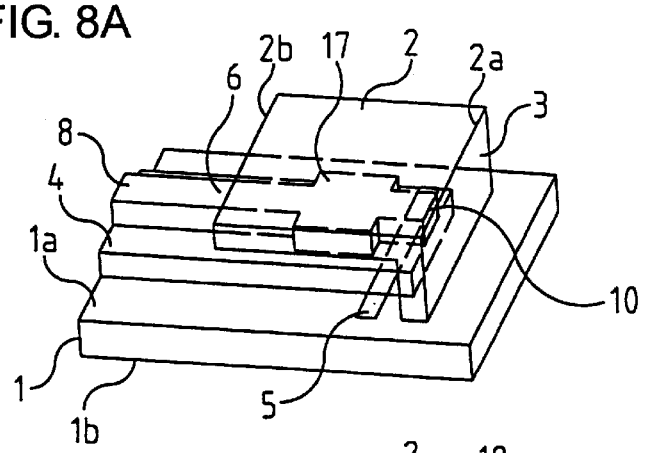
FIGS. 8A–D are perspective views of an embodiment according to the invention, with alternative feeding arrangements and variations thereof.

Referring to FIG. 8A, the end 10 of the feeding conductor 6 is electrically connected to the grounding means 3 or the ground plane 1.

Figure 8B:
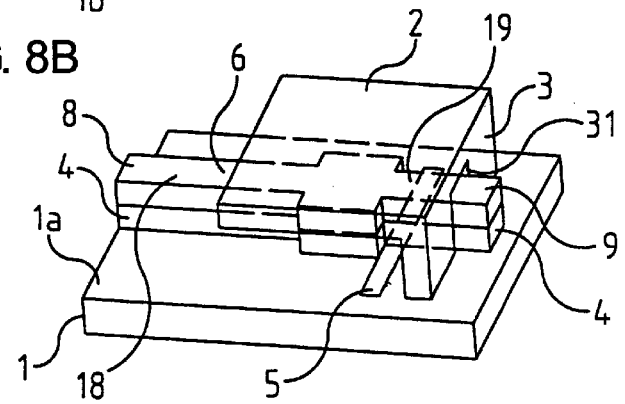

As illustrated in FIG. 8B, the grounding means 3 is provided with an opening 31 through which the feeding conductor extends. The opening 31 shall be of such a size that there will be no electrical contact between the feeding conductor 6 and the grounding means 3. The space between the grounding means 3 and the feeding conductor 6 in the opening 31 can be filled with an insulating material.

Figure 8C:
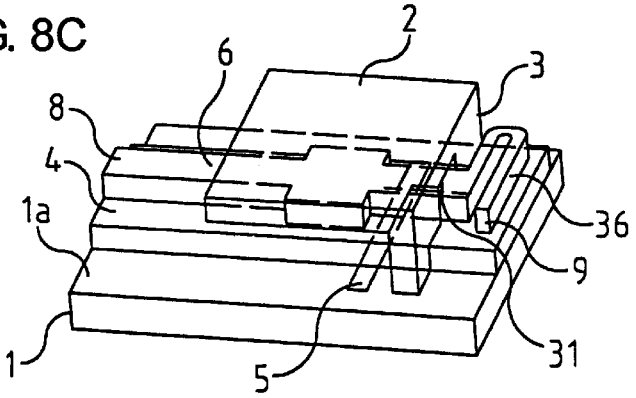

As illustrated in FIG. 8C the feeding conductor 6 is bent in a U-shape 36 at its end 9 in order to achieve the desired length between the slot 5 and the end. The end 9 is an open end.

Figure 8D:
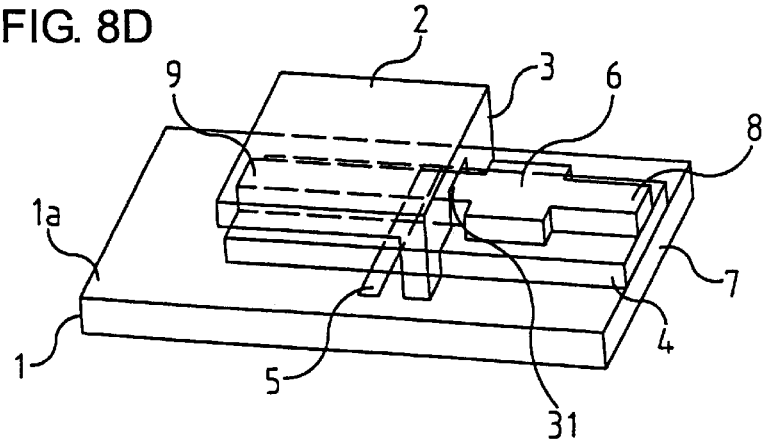

The antenna device illustrated in FIG. 8D is similar to the antenna device in FIG. 8A with the difference that it is fed from the opposite side, i.e. the feeding conductor 6 extends from the feed portion 8 through the grounding means 3 and thereafter across the slot. Its end 9, 10 can be free or connected to the ground plane 1. It could also be provided with an U-shaped end which is open.

In the operation as a transmitting antenna, the feeding conductor 6 will excite the aperture 5, creating an electromagnetic filed across the aperture 5. For best efficiency it is desired that the feeding conductor 6 has a current maximum over the aperture. This is achieved by choosing an optimal length of the feeding conductor 6 between the aperture 5 and its end 9. This length is preferred to be approximately one quarter of the actual wavelength in all the embodiments with an open end. Alternatively a current maximum over the aperture can be achieved by connecting the feeding conductor to the ground plane 1 or the grounding means 3 at its end 10 directly after extending over the aperture 5. An electromagnetic field is then created between the ground plane 1 and the patch 2 (or conductive second plate). This field travels towards the free end 2*b* of the patch, where the antenna radiates in a direction essentially perpendicular to ground plane 1 and the patch 2.

Although embodiments have been described, having one feeding conductor 6 on either the outer side 1*a* or the inner side 1*b* of the ground plane 1, an antenna device according to the invention could include two or more feeding conductors 6, with preferably at least one feeding conductor 6 one each side. They are possibly exciting separate aperture slots, arranged e.g. as described in connection to FIGS. 5B–C, 6F–L and 6N. The feeding portions 8 can then be placed at or near different edges or the same edge of the ground plane 1.

Figure 9A:
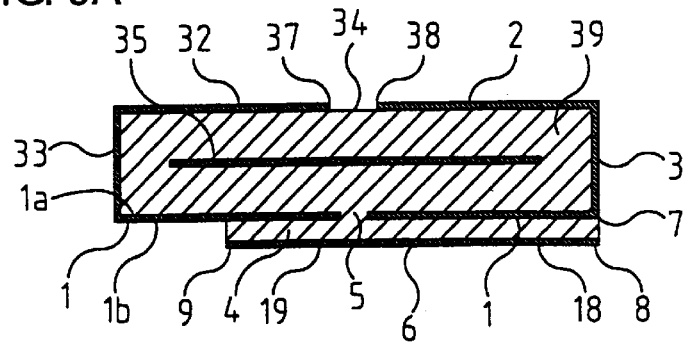
FIGS. 9A–E illustrate an embodiment according to the invention, of an antenna device with a radiating slot, and variations thereof.

FIG. 9A is a cross-sectional view of an embodiment of an antenna device according to the invention. A ground plane 1 is provided with a slot aperture 5, preferably in the centre of the plane. Two grounding means 33, 3 are connected to the ground plane 1 at a first side 1*a* along two opposed edges thereof. Two conductive plates 32, 2 are connected to the grounding means 33, 3 respectively, at edges opposed to the edges connected to the ground plane. Thereby the grounding means 33, 3 interconnect the plates 32, 2 and the ground plane 1. The plates 32, 2 extend towards each other, from the respective grounding means 33, 3, and end at edges 37, 38, respectively. The edges 37 and 38 limit a radiating slot 34.

Between the ground plane 1 and the plates 32, 2 there is a metallic layer or conductive plate 35 arranged, preferably parallel to and at the same (or approximately the same) distance L6 from the ground plane 1 and the plates 32, 2. The metallic layer or conductive plate 35 has edges facing the grounding means 33, 3, with a spacing therebetween along each edge. This spacing is approximately equal to the distance L6. The distance between the said edges of the metallic layer or the conductive plate 35 is approximately one quarter of the wavelength, at the actual frequency. The metallic layer or conductive plate 35 is electrically insulated from the surrounding conductive parts 1, 3, 33, 32, 2, preferably by a dielectric, filling the space 39, or by any other suitable method of keeping them electrically separated. If a dielectric is used to fill the space it could be a homogeneous dielectric or an inhomogeneous dielectric, such as a foam.

On the second side 1*b* of the ground plane 1, there is provided a dielectric plate 4 which is attached to the ground plane on one side and carries a feeding conductor 6 on the other.

The feeding conductor 6 extends across the slot 5, preferably perpendicular to the slot 5. The feeding conductor 6 consists in order of a feed portion 8 which is connected to telephone circuitry (not shown), a first line portion 18, possibly a means for matching the impedance of the antenna to a standardized impedance of the circuitry, a second line portion 19 extending across the slot 5, and an open end 9 preferably at a distance from the slot of approximately one quarter of the actual wavelength. The end can alternatively be connected to the ground plane 1 directly after the feeding conductor have extended across the slot. The feeding conductor 6 can be terminated according to any of the variations of terminating a feeding conductor 6 as described with reference to FIGS. 8A–D.

In this way, an effective feed is attained. However, there are many alternative configurations of the aperture and the feed line. The ground plane 1 is also connected at a feeding or grounding portion 7 thereof to the telephone circuitry.

Operating as a transmitting antenna the feeding conductor 6 will excite the slot aperture 5, creating an electromagnetic field across the aperture 5. An electromagnetic field is then created between the ground plane and the metallic layer or conductive plate 35. This field is spread perpendicular to the field in both directions towards the grounding means 33, 3 respectively between the metallic layer or conductive plate 35 and the ground plane 1, travels between the metallic layer or conductive plate 35 and the grounding means 33, 3 and further between the metallic layer or conductive plate 35 and the plates 32, 2 to create a field across the radiating slot 34 where the signal is radiated.

The antenna device provided by this construction has a more defined radiating area, which makes it less sensitive to disturbing effects from surrounding parts or components.

Figure 9B:
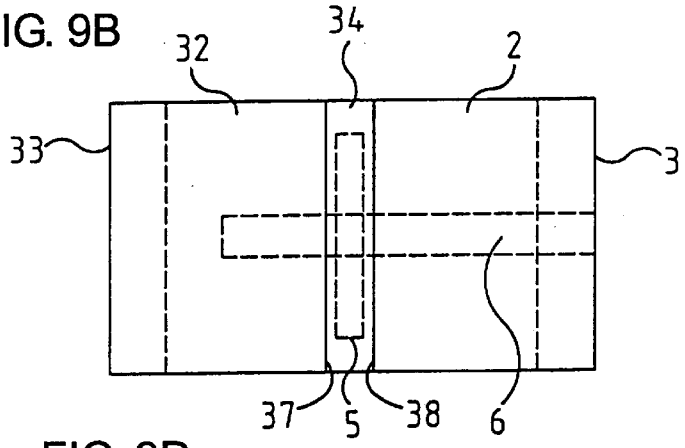

As seen in FIG. 9B, which is a top view of the antenna device illustrated in FIG. 9A, the edges 37 and 38 are parallel, which forms a rectangular slot.

Figure 9D:
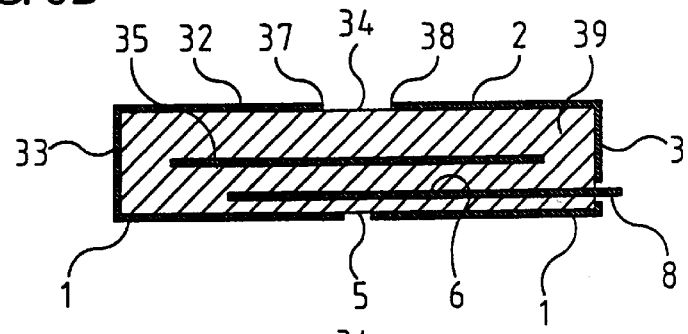
Figure 9E:
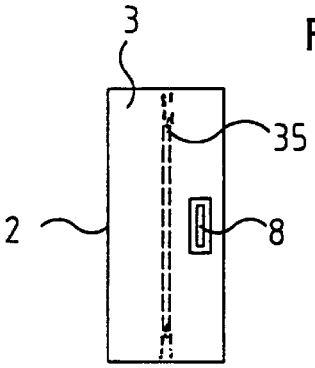
Figure 9C:
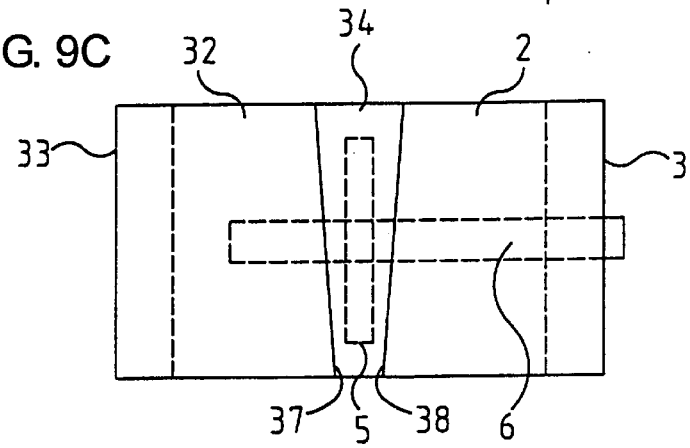

FIG. 9C, is an alternative top view of the antenna device illustrated in FIG. 9A. Through varying the width of the slot 34 along the edges 37 and 38 another bandwidth is achieved than in the device having a rectangular slot. In FIG. 9C the slot 34 is symmetric to a central axis through the slot, and provided with straight edges. Other forms of the slot are possible, which will give the device different bandwidths.

Referring to FIG. 9D an antenna device similar to the one described in connection with FIG. 9A is shown in a cross-section view. The difference is the location of the feeding conductor 6 which is placed between the ground plane 1 and the metallic layer or conductive plate 35.

As illustrated in FIG. 9E, which is a side view from the right of the device in FIG. 9D, the feed portion 8 of the feeding conductor 6 is arranged near the grounding means 3, which has an opening or aperture through which the feeding conductor 6 extends. The feeding conductor 6 further extends between the ground plane 1 and the metallic layer or conductive plate 35, possibly exhibiting a means for matching the impedance of the antenna to a standardized impedance of the circuitry, continues across the slot, and has an open end 9 preferably at a distance of essentially one quarter of the actual wavelength, from the aperture. The end can alternatively be connected to the ground plane 1. The feeding conductor can be terminated according to any of the variations of terminating a feeding conductor 6 as described with reference to FIGS. 8A–D.

In this embodiment, the space 39 as well as the space between the grounding means 3 and the feeding conductor 6, can be filled or isolation can be provided for, in accordance with the embodiment described with reference to FIG. 9A.

For clarity, FIG. 4 shows details of different embodiments to be further explained with reference to FIG. 6. FIG. 4 specifically shows patches, grounding means, slots in the patches. FIGS. 4A–H show free-standing metal plate embodiments to the left and embodiments with metal on dielectric a carrier to the right. FIG. 4I shows a T-shape element, which includes two patches with a common ground, the patches having different lengths and thus different fundamental frequencies. One of the patches 11 is provided with a slot at the end remote from the grounding. That arrangements facilitates the excitation of the patch in two different modes. FIG. 4C shows two stacked patches with different lengths providing a wider operating frequency band for the antenna or, in fact, operability within two separated frequency bands. FIGS. 4J–K illustrate longitudinal slots in a G-structure and a L-element antenna, wherein the two parts formed may have different dimensions to improve bandwidth. Further, the width of such a slot can be adapted to obtain desired bandwidth and impedance.

Figure 5A:
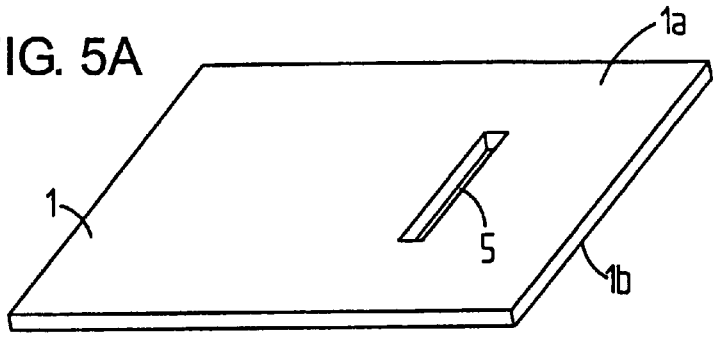
FIGS. 5A–C show different embodiments and variations of the ground plane of FIG. 3.
Figure 5B:
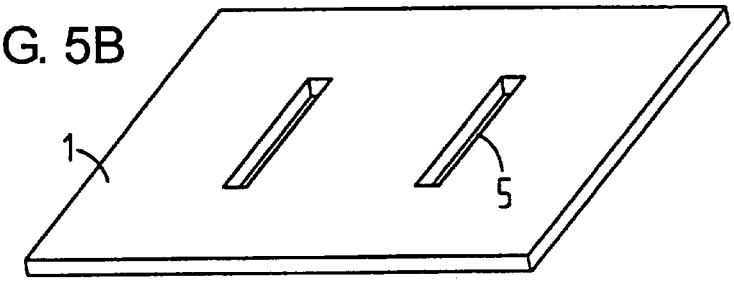
Figure 5C:
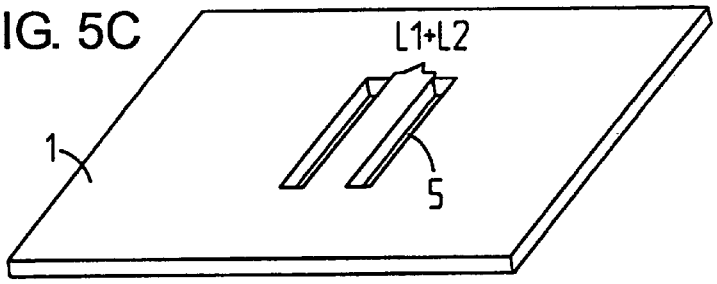
Figure 5D:
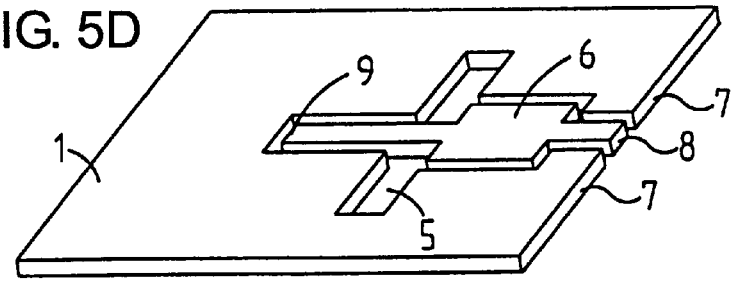
FIGS. 5D–E show an embodiment and variations thereof wherein the ground plane and feed conductor of FIG. 3 are integrated.
Figure 5E:
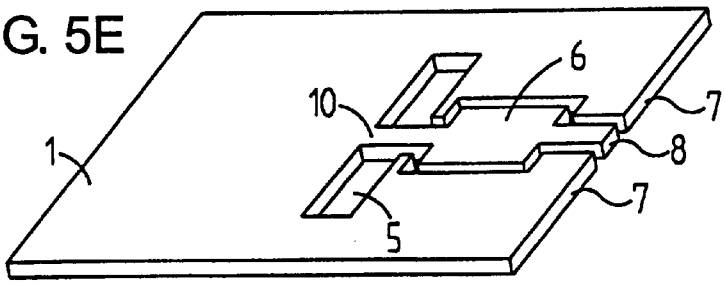

FIGS. 5A–C illustrate respectively the feeding apertures for an L-element or F-element or G-structure, and for a G-structure, for a T-element. FIGS. 5D–E show how the feeding conductor is integrated in the ground plane in the form of a co-planar wave guide with an open end (stub) and a shorted end, respectively.

Figure 7A:
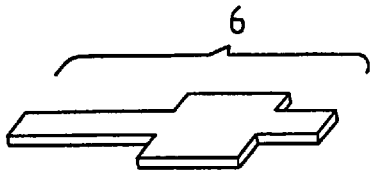
FIGS. 7A–F show alternative feed arrangements of the embodiments.
Figure 7B:
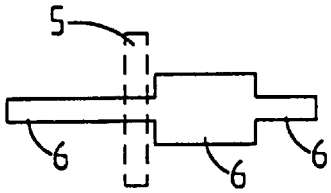
Figure 7C:
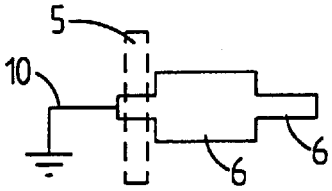
Figure 7D:
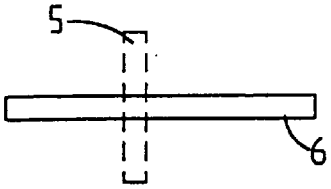
Figure 7E:
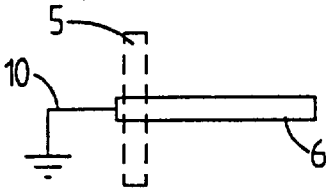
Figure 7F:
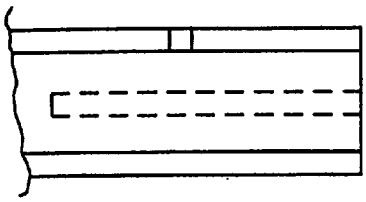

FIGS. 7A–F shows the interrelation of the feeding conductor 6 and the slot. In FIGS. 7A–E the different combinations of line conductors, transformers, grounded ends, and open ends are shown. FIG. 7F indicated by dashed lines from the side how a feeding conductor, sandwiches in a dielectric between the ground plane and a further conductive plate, may be employed in the invention to couple through a aperture.

Figure 6A:
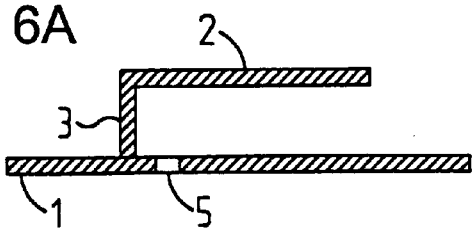
FIGS. 6A–B show L-element variations of the embodiments.
Figure 6B:
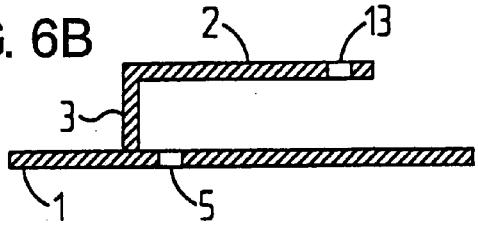
Figure 6C:
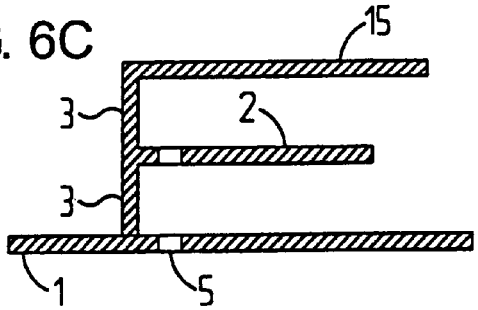
FIGS. 6C–E show F-element variations of the embodiments.
Figure 6D:
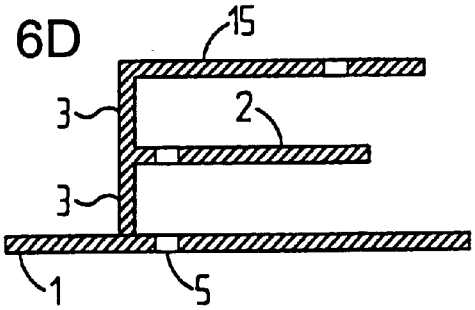
Figure 6E:
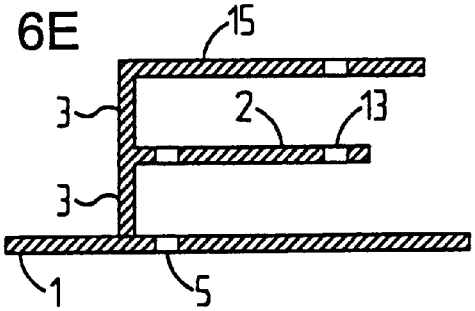
Figure 6F:
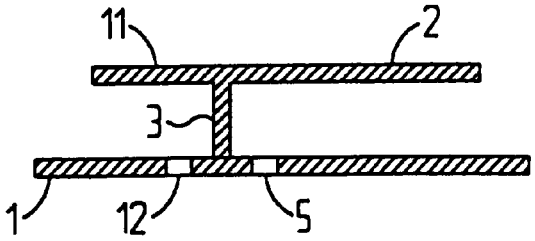
FIGS. 6F–I show T-element variations of the embodiments.
Figure 6G:
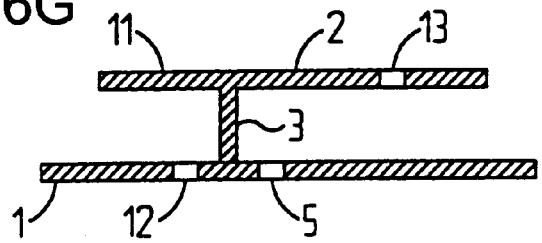
Figure 6H:
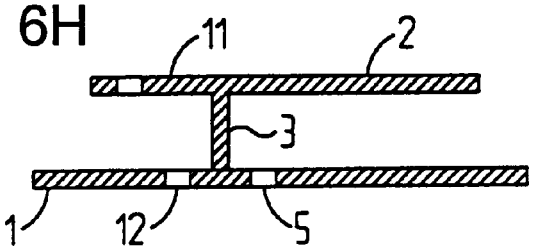
Figure 6I:
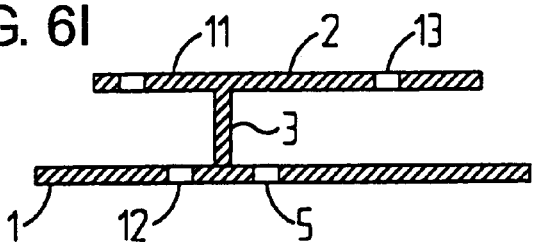
Figure 6J:
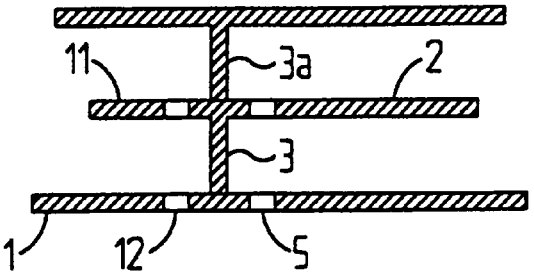
FIGS. 6J–L show stacked T-element variations of the embodiments.
Figure 6K:
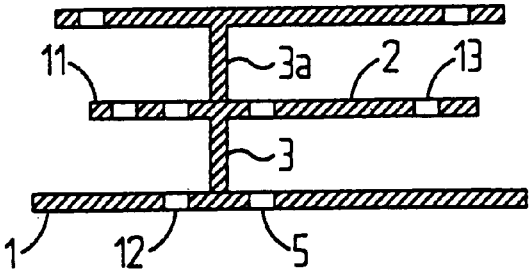
Figure 6L:
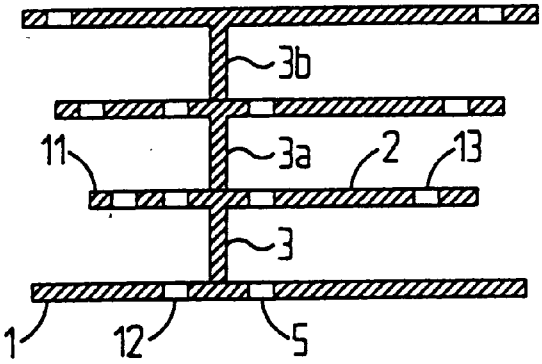
Figure 6M:
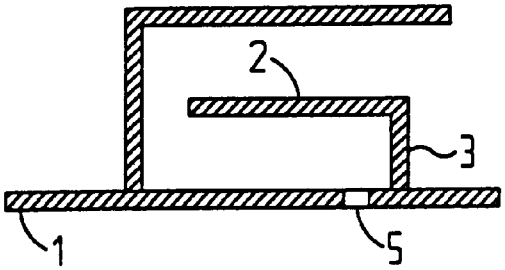
FIGS. 6M–N show G-structure variations of the embodiments.
Figure 6N:
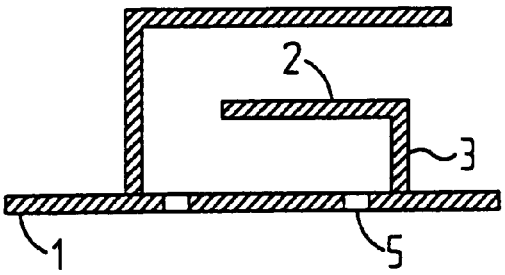

FIGS. 6A–N show "profiles" of different, advantageous embodiments of the invention. The reference numerals are common for common parts in these figures. FIG. 6A discloses a basic inventive concept, wherein a radiating patch 2 is mounted by a grounding means 3 on ground plane 1 having an aperture in the proximity of the grounding means 3. By feeding the patch, which is basically of quarter wave type, through a non-resonant aperture 5, an improved bandwidth and less sensitivity to an exact feed point are attained.

Single level or stacked T-elements of FIGS. 6F–L are fed trough two apertures 5, 12 in the ground plane 1. These two apertures are located close to each other in order to obtain correct phasing of the radiating patches. In the case of stacked elements, intermediate level patches are each provided with an aperture for transferring part of the radiation energy from the ground plane aperture(s) to patches at higher levels.

By a G-structure radiator, according to the invention, as illustrated in FIGS. 6M–N a compactness is achieved while the distance for the electromagnetic field to travel within the antenna is maintained. FIG. 6M illustrates a G-structure radiator with one aperture slot fed by one single feeding conductor. FIG. 6N illustrates a G-structure radiator operable within two separated frequency bands, and is provided with a respective aperture for each band. The apertures are fed by one feeding conductor each.

Figure 10A:
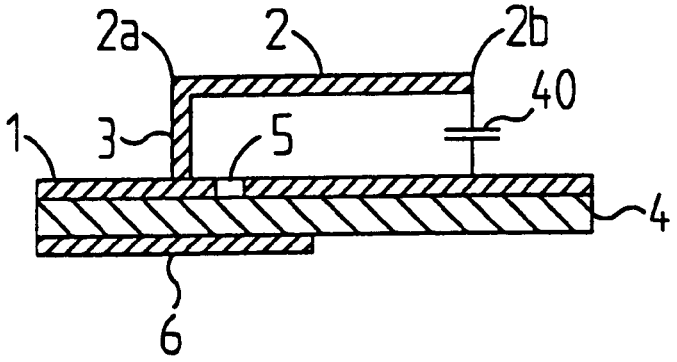
FIGS. 10A–C illustrate embodiments according to the invention, of an antenna device provided with capacitances in order to reduce the dimensions.
Figure 10B:
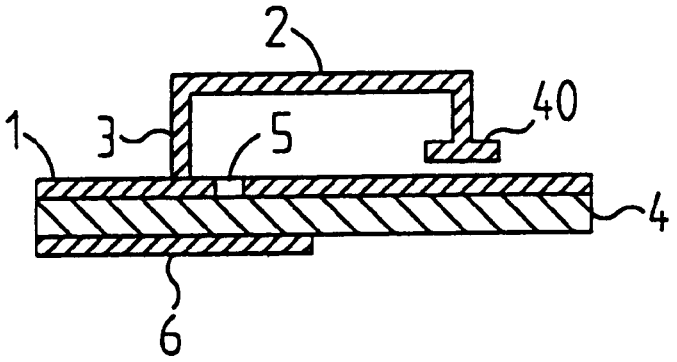
Figure 10C:
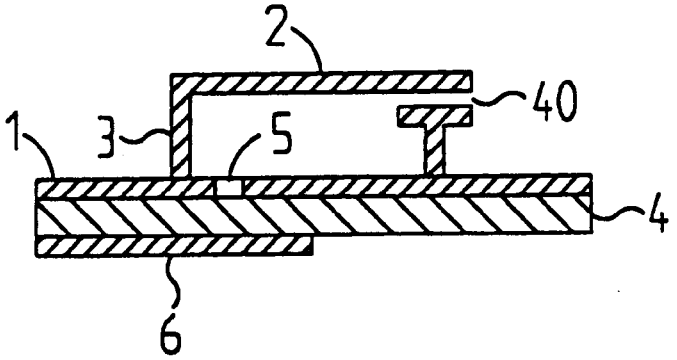

Referring to FIGS. 10A–C an antenna is provided with a capacitance between the ground plane 1 and an edge 2*b* of the patch which is opposite to the edge 2*a* which is connected to the grounding means 3. By such a use of a capacitance the patch appears electrically to be longer (the distance between 2*a* and 2*b* (the edge connected to the grounding means and the opposite edge connected to the capacitance)), which makes it possible to reduce the physical length, and thereby providing a smaller antenna device. The capacitance can include one or more capacitors, as illustrated in FIG. 10A. It can alternatively be formed from one elongate plate (layer) or a number of plates (layers) arranged parallel to and at a small distance from the ground plane 1 or the patch 2, as illustrated in FIGS. 10B and 10C respectively. The plate(s) or layer(s) are connected to the patch 2 or the ground plane 1 respectively by conductor(s) or an elongate conductive plate (layer) or conductive plates (layers) extending essentially perpendicular to the ground plane, as illustrated in FIGS. 10B and 10C respectively. Preferably the capacitances and their connections are formed by metallic layers on dielectric substrate(s).

It should be noted that the drawings may indicate proportions and dimensions of components of the antenna device. However, e.g., thickness of conductive layers have been exaggerated for clarity. Although, in many embodiments conductive plates have been mentioned, it is understood that it includes the use of conductive layers, possibly attached to dielectric substrate(s). Although the invention is described by means of the above examples, naturally, a skilled person would appreciate that many other variations than those explicitly disclosed are possible within the scope of the invention.

We claim:

1. An antenna device for a portable radio communication device, comprising:

a conductive first plate, a conductive second plate parallel to and spaced by a first spacing apart from the first plate on a first side thereof and having a first edge, a conductive first grounding means essentially perpendicular to and interconnecting the first and second plates along a portion of the first edge of the second plate, the first plate provided with a first aperture at a first distance from the first grounding means, a first conductor extending across the first aperture, the first plate and the first conductor providing first and second feed portions, respectively, to be connected to transmitting/receiving circuitry of the radio communication device, and another structure including a third conductive plate and a second grounding means corresponding to the second plate and the first grounding means, respectively, is arranged so as to form, together with a portion of the first conductive plate, a side profile having a general form of the capital letter G.

2. The antenna device according to claim 1, wherein the first conductor provides the second feed portion at the one side of the first aperture and has on the other side an open end at essentially one quarter of a wavelength.

3. The antenna device according to claim 1, wherein the first conductor provides the second feed portion at the one side of the first aperture and is connected essentially immediately on the other side to the first plate.

4. The antenna device according to claim 1, wherein the second plate is provided with a second aperture at a second distance from the first grounding means so as to facilitate excitation of the second plate in two different resonant modes.

5. The antenna device according to claim 1, wherein the first conductor extends across the first aperture parallel to and spaced apart from the first plate on a second side thereof.

6. The antenna device according to claim 1, wherein the first conductor extends across the first aperture spaced apart from the first plate on the first side thereof.

7. The antenna device according to claim 6, wherein the first conductor extends through an opening in the first grounding means, and the first conductor and the first grounding means are electrically insulated from each other.

8. The antenna device according to claim 6, wherein the first plate is provided with a second aperture at a distance from the first grounding means, a second conductor extends across the second aperture parallel to and spaced apart from the first plate on a second side thereof, the second conductor providing a third feed portion, to be connected to transmitting/receiving circuitry of the radio communication device.

9. The antenna device according to claim 1, wherein the first conductor is arranged in a same plane as the first plate which has a slot in order to leave a spacing between the first plate and the first conductor, said spacing extending on both sides of the first conductor at least from the second feed portion to the first aperture.

10. The antenna device according to claim 1, said another structure further including a second aperture corresponding to the first aperture, so as to facilitate operation within two separated frequency bands.

11. The antenna device according to claim 1, wherein the first conductor includes a transmission line being at least one in a group consisting of a microstrip line, a stripline, and a coplanar wave guide.

12. The antenna device according to claim 1, wherein the first aperture has essentially a shape of one in a group consisting of a rectangle, a circle, an oval, an ellipse, a bow tie, and an arc.

13. The antenna device according to claim 1, wherein the first conductor includes a quarter wave transformer and at least one transmission line segment.

14. The antenna device according to claim 1, wherein the second and third conductive plates are each provided with at least one dividing slot formed by two or more substantially coextending plate portions.

15. An antenna device for a portable radio communication device, comprising:

a conductive first plate, a conductive second plate parallel to and spaced by a first spacing apart from the first plate on a first side thereof, and having a first edge, a conductive grounding means essentially perpendicular to and interconnecting the first and second plates along a portion of the first edge of the second plate, the first plate provided with a first aperture at a first distance from the grounding means, a first conductor extending across the first aperture spaced apart from the first plate on the first side thereof, and the first plate and the first conductor providing first and second feed portions, respectively, to be connected to transmitting/receiving circuitry of the radio communication device.

16. The antenna device according to claim 15 wherein the first conductor extends through an opening in the grounding means, the first conductor and the grounding means are electrically insulated from each other.

17. The antenna device according to claim 15, wherein the first plate is provided with a second aperture at a distance from the grounding means, a second conductor extending across the second aperture parallel to and spaced apart from the first plate on a second side thereof, the second conductor providing a third feed portion, to be connected to transmitting/receiving circuitry of the radio communication device.

18. The antenna device according to claim 15, wherein the first conductor provides the second feed portion at the one side of the first aperture and has on the other side an open end at essentially one quarter of a wavelength.

19. The antenna device according to claim 15, wherein the first conductor provides the second feed portion at the one side of the first aperture and is connected essentially immediately on the other side to the first plate.

20. An antenna device according to claim 15, wherein the second plate is provided with a second aperture at a second distance from the grounding means so as to facilitate excitation of the second plate in two different resonant modes.

21. The antenna device according to claim 15, wherein the antenna device further comprises a conductive third plate parallel to and spaced apart from the first plate on the first side thereof, the third plate connected to the second plate at the first edge and extending from the first edge in a direction opposite to that of the second plate, the first plate is provided with a second aperture at a second distance from the grounding means at a side thereof opposite to that of the first aperture, the first conductor extending across the second aperture as well as across the first aperture.

22. The antenna device according to claim 21, wherein the third plate is provided with a third aperture at a third distance from the grounding means so as to facilitate excitation of the third plate in two different resonant modes.

23. The antenna device according to claim 15, wherein the first conductor includes a transmission line being at least one in a group consisting of a microstrip line, a stripline, and a coplanar wave guide.

24. The antenna device according to claim 15, wherein the first aperture has essentially a shape of one in a group consisting of a rectangle, a circle, an oval, an ellipse, a bow tie, and an arc.

25. The antenna device according to claim 15, wherein the first conductor includes a quarter wave transformer and at least one transmission line segment.

26. The antenna device according to claim 15, wherein the second conductive plate is provided with at least one dividing slot formed by two or more substantially coextending plate portions.

27. An antenna device for a portable radio communication device, comprising;

a conductive first plate, a conductive second plate parallel to and spaced by a first spacing apart from the first plate on a first side thereof and having a first edge, a conductive grounding means essentially perpendicular to the first and second plates and interconnecting the first and second plates along a portion of the first edge of the second plate, the first plate provided with a first aperture at a first distance from the grounding means, a first conductor extending across the first aperture, the first plate and the first conductor providing first and second feed portions, respectively, to be connected to transmitting/receiving circuitry of the radio communication device, and the first conductor providing the second feed portion at a first side of the first aperture and is connected essentially immediately on a second side of the first aperture to the first plate.

28. The antenna device according to claim 27, wherein the second plate is provided with a second aperture at a second distance from the grounding means so as to facilitate excitation of the second plate in two different resonant modes.

29. The antenna device according to claim 27, wherein the antenna device further comprises a conductive third plate parallel to and spaced apart from the first plate on the first side thereof, the third plate connected to the second plate at the first edge and extends from the first edge in a direction opposite to that of the second plate, the first plate is provided with a second aperture at a second distance from the grounding means at a side thereof opposite to that of the first aperture, the first conductor extending across the second aperture as well as across the first aperture.

30. The antenna device according to claim 29, wherein the third plate is provided with a third aperture at a third distance from the grounding means so as to facilitate excitation of the third plate in two different resonant modes.

31. The antenna device according to claim 27, wherein the first conductor includes a transmission line being at least one in a group consisting of a microstrip line, a stripline, and a coplanar wave guide.

32. The antenna device according to claim 27, wherein the first aperture has essentially a shape of one in a group consisting of a rectangle, a circle, an oval, an ellipse, a bow tie, and an arc.

33. The antenna device according to claim 27, wherein the first conductor includes a quarter wave transformer and at least one transmission line segment.

34. The antenna device according to claim 27, wherein the second conductive plate is provided with at least one dividing slot formed by two or more substantially coextending plate portions.

35. An antenna device for a portable radio communication device, comprising:

a conductive first plate, a conductive second plate parallel to and spaced by a first spacing apart from the first plate on a first side thereof and having a first edge, a conductive grounding means essentially perpendicular to and interconnecting the first and second plates along a portion of the first edge of the second plate, the first plate provided with a first aperture at a first distance from the grounding means, a first conductor extending across the first aperture, the first plate and the first conductor providing first and second feed portion, respectively, to be connected to transmitting/receiving circuitry of the radio communication device, and the first conductor arranged in a same plane as a the first plate which has a slot in order to leave a spacing between the first plate and the first conductor, said spacing extending on both sides of the first conductor at least from the second feed portion to the first aperture.

36. The antenna device according to claim 35, wherein the first conductor provides the second feed portion at a first side of the first aperture and has on a second side an open end at essentially one quarter of a wavelength.

37. The antenna device according to claim 35, wherein the first conductor provides the second feed portion at a first side of the first aperture and is connected essentially immediately on a second side to the first plate.

38. The antenna device according to claim 35, wherein the second plate is provided with a second aperture at a second distance from the grounding means so as to facilitate excitation of the second plate in two different resonant modes.

39. The antenna device according to claim 35, wherein the antenna device further comprises a conductive third plate parallel to and spaced apart from the first plate on the first side thereof, the third plate connected to the second plate at the first edge and extends from the first edge in a direction opposite to that of the second plate, the first plate is provided with a second aperture at a second distance from the grounding means at a side thereof opposite to that of the first aperture, the first conductor extends across the second aperture and across the first aperture.

40. The antenna device according to claim 39, wherein the third plate is provided with a third aperture at a third distance from the grounding means so as to facilitate excitation of the third plate in two different resonant modes.

41. The antenna device according to claim 35, wherein the first aperture has essentially a shape of one in a group consisting of a rectangle, a circle, an oval, an ellipse, a bow tie, and an arc.

42. The antenna device according to claim 35, wherein the first conductor includes a quarter wave transformer and at least one transmission line segment.

43. The antenna device according to claim 35, wherein the second conductive plate is provided with at least one dividing slot formed by two or more substantially coextending plate portions.

44. An antenna device for a portable radio communication device, comprising:

a conductive first plate, a conductive second plate parallel to and spaced by a first spacing apart from the first plate on a first side thereof and having a first edge, a conductive first grounding means essentially perpendicular to and interconnecting the first and second plates along a portion of the first edge of the second plate, the first plate provided with a first aperture at a first distance from the first grounding means, a first conductor extending across the first aperture, the first plate and the first conductor providing first and second feed portions, respectively, to be connected to transmitting/receiving circuitry of the radio communication device, the conductive first plate is provided with a second grounding means, on the first side of said first plate and opposite to the firsnt grounding means, the first aperture is located between the first grounding means and the second grounding means, a third conductive plate interconnected at a first edge to the conductive first plate via the second grounding means, the second and third conductive plates extending from their respective grounding means towards each other, leaving a spacing between the edges that are facing each other, and a conductive layer arranged between the conductive first, second and third plates.

45. The antenna device according to claim 44, wherein the second and third conductive plates are arranged in a same plane and are parallel to the conductive first plate and the conductive layer, the first and second grounding means are arranged parallel to each other at opposed edges of the conductive first plate, the first aperture is parallel to the second grounding means.

46. The antenna device according to claim 44, wherein the first conductor extends across the first aperture parallel to and spaced apart from the first plate on a second side thereof.

47. The antenna device according to claim 44, wherein the first conductor extends across the first aperture spaced apart from the first plate on the first side thereof.

48. The antenna device according to claim 47, wherein the first conductor extends through an opening or aperture in the first grounding means, the first conductor and the first grounding means are electrically insulated from each other.

49. The antenna device according to claim 44, wherein the first conductor is arranged in a same plane as the first plate which has a slot in order to leave a spacing between the first plate and the first conductor, said spacing extending on both sides of the first conductor at least from the second feed portion to the first aperture.

50. The antenna device according to claim 44, wherein the first conductor provides the second feed portion at the one side of the first aperture and has on the other side an open end at essentially one quarter of a wavelength.

51. The antenna device according to claim 44, wherein the first conductor provides the second feed portion at the one side of the first aperture and is connected essentially immediately on the other side to the first plate.

52. The antenna device according to claim 44, wherein the first conductor includes a transmission line being at least one in a group consisting of a microstrip line, a stripline, and a coplanar wave guide.

53. The antenna device according to claim 44, wherein the first aperture has essentially a shape of one in a group consisting of a rectangle, a circle, an oval, an ellipse, a bow tie, and an arc.

54. The antenna device according to claim 44, wherein the first conductor includes a quarter wave transformer and at least one transmission line.

55. The antenna device according to claim 44, wherein the second and third conductive plates are each provided with at least one dividing slot formed by two or more substantially coextending plate portions.

* * * * *